US005316171A

United States Patent [19]

Danner, Jr. et al.

[11] Patent Number: 5,316,171

[45] Date of Patent: May 31, 1994

[54] VACUUM INSULATED CONTAINER

[76] Inventors: Harold J. Danner, Jr., 117 Oravetz Rd., Auburn, Wash. 98002; William B. Holmes, 15454 - 139th Ave. SE., Renton, Wash. 98058; Wesley Barron, 5000 Dairy Rd., Kamloops, B.C., Canada V2C 1Z3

[21] Appl. No.: 955,354

[22] Filed: Oct. 1, 1992

[51] Int. Cl.[5] ..... B65D 90/04

[52] U.S. Cl. ..... 220/423; 220/424; 220/425

[58] Field of Search ..... 220/420, 423, 424, 425

[56] References Cited

U.S. PATENT DOCUMENTS

| | | | |
|---|---|---|---|
| 3,199,715 | 8/1965 | Paivanas | 220/424 |
| 3,289,423 | 12/1966 | Berner et al. | 220/423 |
| 3,514,006 | 5/1970 | Molnar | 220/423 |
| 4,427,123 | 1/1984 | Komeda et al. | 220/424 |
| 4,461,398 | 7/1984 | Argy | 220/424 |
| 4,560,075 | 12/1985 | Lu | 220/424 |

*Primary Examiner*—Joseph Man-Fu Moy
*Attorney, Agent, or Firm*—Hughes & Multer

[57] ABSTRACT

A thermal insulating shipping container having an elongate rectangular box-like configuration, made up of panels, each having an evacuated area therein. Each panel comprises inner and outer panel sections each having inner and outer skins and a honeycomb core. Standoff units in the evacuated area resist compression loads exerted on the inner and outer panel sections, and a radiation shield is positioned in the evacuated area.

17 Claims, 11 Drawing Sheets

VACUUM INSULATED CONTAINER

FIELD OF THE INVENTION

The present invention relates to vacuum insulated containers, and more particularly to such containers adapted for shipment of cargo which must be refrigerated or otherwise thermally insulated from the ambient environment.

BACKGROUND ART

There are various products which require thermal insulation during shipment, one of the more common of these being frozen food stuffs. Even though the quality of insulating material and techniques have improved over the years, the thermal insulation provided by present day commercial shipping containers is not able to maintain the contained product within the proper temperature range over longer periods of time, without using refrigerating techniques or some other means in addition to providing insulation.

It has long been known that excellent insulating capability can be obtained by providing a vacuum between two members, a common device utilizing this principle being the vacuum flask. Such a flask is made up of inner and outer walls which are spaced from one another, with a vacuum being provided in the space between the two walls. Primarily for structural reasons, the two walls are formed as concentric cylindrical sidewall sections, with the ends of the cylinders being closed by concentric hemispherical sections. An opening is provided through one of the end hemispherical sections.

However, the walls of even a relatively small vacuum flask are subjected to rather substantial forces. With the atmospheric pressure being approximately fifteen pounds per square inch (PSI) at sea level, the outside wall of a three inch diameter by twelve inch long standard vacuum bottle is subjected to a total lateral force of as much as approximately 540 pounds. The internal wall of the flask does not require as heavy a wall, since the internal forces are directed radially outwardly, so that the material forming the inner wall is in tension, with there being no buckling tendency. However, the outer wall experiences what can be described as a crushing force, and the outer wall must be made structurally stronger to withstand the forces which would tend to buckle the outer wall. Further, the structural problems become more difficult to solve as the size of the container becomes larger. The structural problems and other related problems in designing a vacuum insulated container in other configurations are often even more substantial.

Another factor is that while cylindrical containers may be reasonably practical for shipment of fluids, the cylindrical containing area is less practical for other types of cargo. Further, when a number of such cylindrical containers are stacked in a cargo area, there is much wasted space between the containers.

Also, there are a number of other design challenges in making an economically feasible shipping container, such as structural strength and durability, economy in manufacture, and other factors. Because of the structural problems and-other problems of providing commercially practical vacuum insulating shipping containers, in many instances the thought of using the evacuated area as insulation is abandoned, and thick high quality insulation is used. Also,.for practical reasons and also for utilizing the cargo space to full advantage, shipping containers are commonly made rectangularly shaped. The end result is (as indicated above) that to maintain quite low temperatures (or more broadly to maintain substantial temperature differentials between the contained cargo and the ambient atmosphere) for long periods of time, even the use of quite thick high quality insulation of itself has not been adequate, and refrigeration or other techniques must be utilized.

SUMMARY OF THE INVENTION

The container of the present invention comprises a plurality of generally planar panels, each of which comprises a first inner air impervious panel section and a second outer air impervious panel section. Each of the first and second panel sections has first and second main panel portions respectively spaced from one another, and also first and second perimeter portions, respectively, which extend entirely around the first and second main panel portions, respectively, and which are joined to one another to form an air impervious perimeter seal. The first and second main panel portions and perimeter portions define an evacuated region between the first and second panel sections.

There is a reflective radiation shield positioned in and extending across the evacuated region. The radiation shield comprises a plurality of reflective sheets positioned and spaced overlapping relationship relative to one another.

There is a plurality of standoff units positioned at laterally spaced intervals in said evacuated regions, and engaging said first and second panels sections to withstand compression loads created by ambient atmosphere pressure against the first and second panel sections.

The panels are joined to one another at edge portions thereof to form a thermally insulating enclosed containing area.

In the preferred form, the panel sections each comprise a first outer and a second interior sheet, and a core having a cellular structure positioned therebetween and connected to, the sheets to form a relatively rigid panel structure to resist the loads created by atmospheric pressure and to transmit said loads into the standoff units. The loads created by atmospheric pressure are reacted into the first and second main panel portions primarily as bending moments in the first and second main panel portions. In the preferred form, the core comprises a honeycomb structure.

Each inner surface of each of the first and second panel sections has an air impervious metallic layer immediately adjacent to the evacuated region capable of preventing any significant outgassing in said evacuated region.

The metal layers extend into an area between the first and second perimeter portions of the panel sections.

Each standoff unit comprises first and second metal standoff plates positioned against inner surfaces of said first and second panel sections, and spacing elements between said first and second panel sections. Each spacing element has first and second contact surface areas to engage said first and second plates. The contact surface areas have a substantially smaller area than the planar dimensions of said first and second plates. Each of the spacing elements in the preferred form has a substantially spherical configuration.

The first plate of each standoff unit has a recess to receive the spacing element to locate said spacing element relative to said first and second plates. Further, at least one of said plates of each standoff unit is, in a preferred form, connected to its related panel section by a bonding agent that permits limited lateral movement. Thus, expansion or contraction of one of said panel sections relative to the other can be accommodated by lateral movement of one of said plates relative to its panel portion.

There is positioned between the first and second perimeter portions if each panel a metallic edge joining member comprising first and second contact layers, positioned against the first and second perimeter portions. Also, this edge joining member has an inwardly facing connecting portion connecting the first and second contact layers and presenting to said evacuated region a substantially continuous metal surface. A bonding agent is positioned within said edge joining member and extends in an outer direction from the evacuated area between the first and second perimeter portions of the first and second panel sections. In a preferred form, the edge joining member comprises a substantially continuous metal sheet member folded over in a "U" shaped configuration to form said edge joining member.

In a preferred configuration, each perimeter portion comprises an edge spacing member positioned inwardly from a plane defined by an inner surface of its related panel section, so that two adjacent edge spacing members space the first and second main panel portions from one another. Each edge spacing member has an inward tapered portion that tapers in an inward direction toward said evacuated region and bears against this related panel section. Thus, compression loads exerted on said first and second panel sections are resisted by the tapered portion of the edge member yielding moderately to distribute loads thereon.

The aforementioned first and second impervious metal layers in the preferred configuration are positioned on inside surfaces of said first and second panel sections and extend over the tapered edge portions of the edge spacing members into an area between the edge spacing members.

At least one of the panel sections has an opening therein, with a mounting ring positioned in the opening, and a plug inserted in the mounting ring to close off the evacuated area. The plug and the mounting ring are arranged with an annular recess formed in one of said ring and plug, and an annular protrusion being formed in the other said ring and plug. An extrudable metallic seal member is positioned within the recess and against the protrusion, in a manner that with the plug being forced into engagement with the ring, the metallic seal member is extruded outwardly into adjacent surfaces of the ring and the plug member.

The container further comprises a cover plate arranged to fit over the plug member and press against the mounting ring. The cover plate and the mounting ring have a yielding seal therebetween to function as a temporary seal prior to said plate pressing against the plug member to cause extrusion of the metallic seal member.

Further, the present invention comprises certain processes for making and assembling the components of the container of the present invention. These and other features of the present invention will become apparent from the following detailed description.

DESCRIPTION OF THE PREFERRED EMBODIMENT

(a) Introduction

One of the primary goals in creating the present invention was to provide a vacuum insulated container of a size and shape that is common to the shipping industry and yet which can provide adequate insulation to eliminate to a large extent the need for refrigerating units or devices to maintain an adequate temperature differential. Also, it was intended that this be done in a manner to follow the requirements of the International Shipping Organization regarding the I.S.O. standards relative to size, volumetric capacity, strength, doors, etc. While the container of the present invention could be used for other applications, the preferred embodiment described herein was designed as having the size and shape of a container common to the shipping industry that does meet these I.S.O. requirements. One such container that is commonly used has the configuration of a rectangular prism, and typical dimensions are that its height and width dimensions are eight feet by eight feet, and the lengthwise dimension forty feet or possibly forty eight feet. However, it is to be understood that it would be quite obvious to use other dimensions and/or configurations within the broader scope of the present invention.

Figure 1:
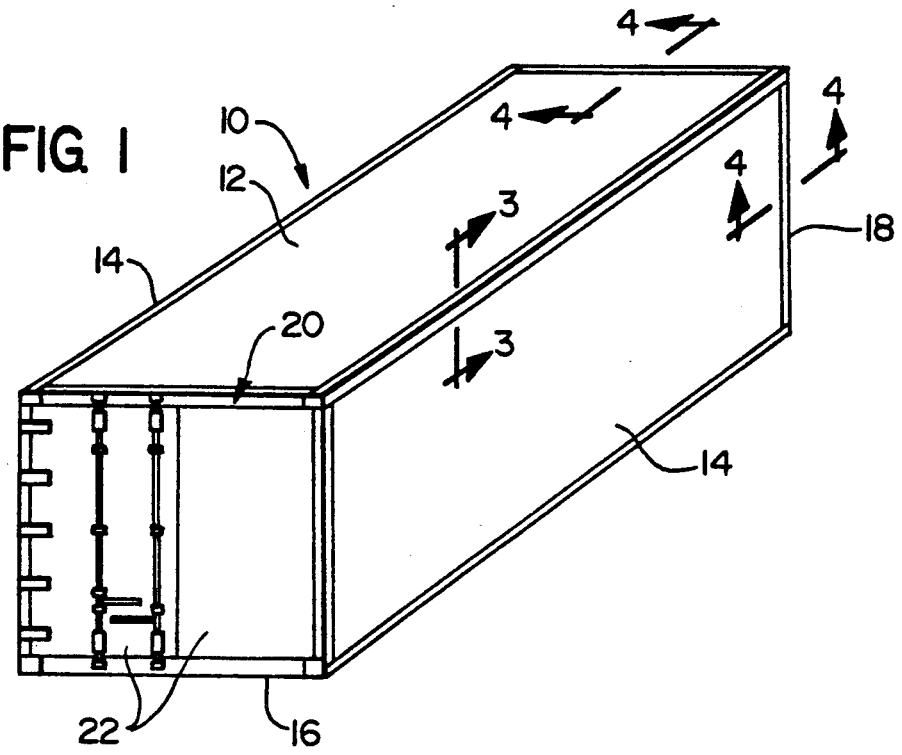
FIG. 1 is an isometric view of a preferred embodiment of the present invention.
Figure 2:
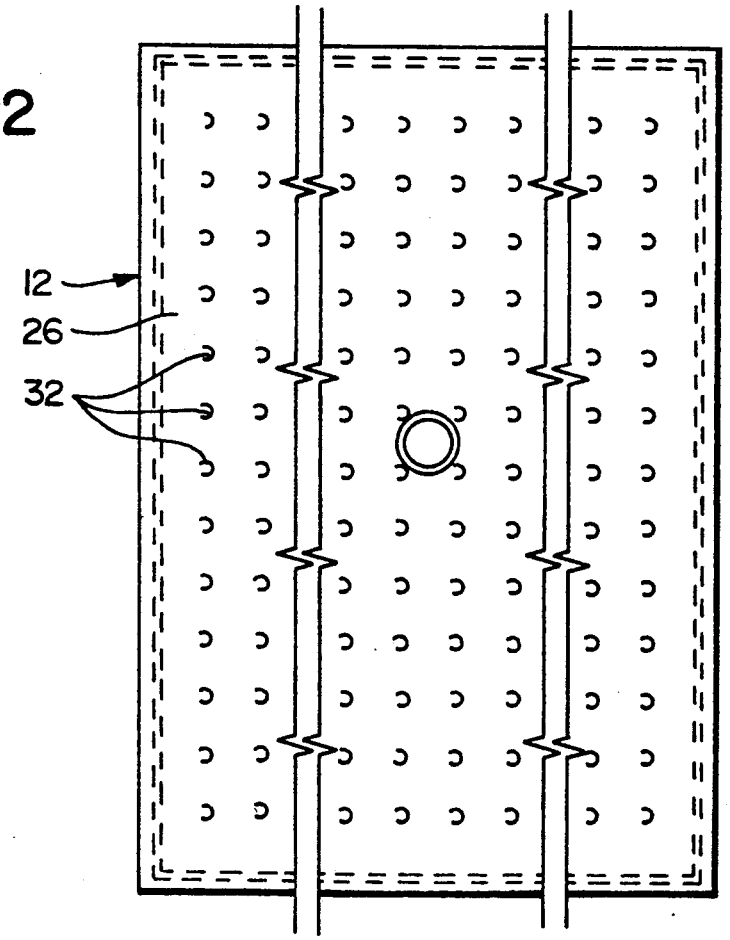
FIG. 2 is a plan view of a single panel used to make the cargo container of the present invention.

Accordingly, with reference to FIG. 1, the cargo container 10 of the present invention is desirably formed as a rectangular prism having a top panel 12, two side panels 14, a bottom floor panel 16, a rear end panel 18, and a front door section 20. The front section 20 is made with two doors 22 which extend over substantially the entire area of the front section 20. Each door 22 has its own separate vacuum insulated panel that is substantially the same as the other panels 12–18.

A critical aspect of the present invention is the construction and configuration of the panels 12 through 18 and the panels in the doors 22, and also the method of manufacturing these panels. It is believed that a clearer understanding of the present invention will be obtained by first describing generally the overall construction of these panels 12 through 18, next describing the overall arrangement in which these are assembled to form the container 10, and then describing in the following sections in more detail the other components, methods and features of the present invention.

(b) Basic Configuration of the Panels 12–20

Each of the panels 12 through 18 have basically the same configuration. Accordingly, in describing the general configuration of the panels 12-18 and also their specific features, for convenience of description, only the panel 12 will be described in detail, it being understood that this same description will apply to the other panels 14 through 18 (and the door panels) as well.

Figure 7:
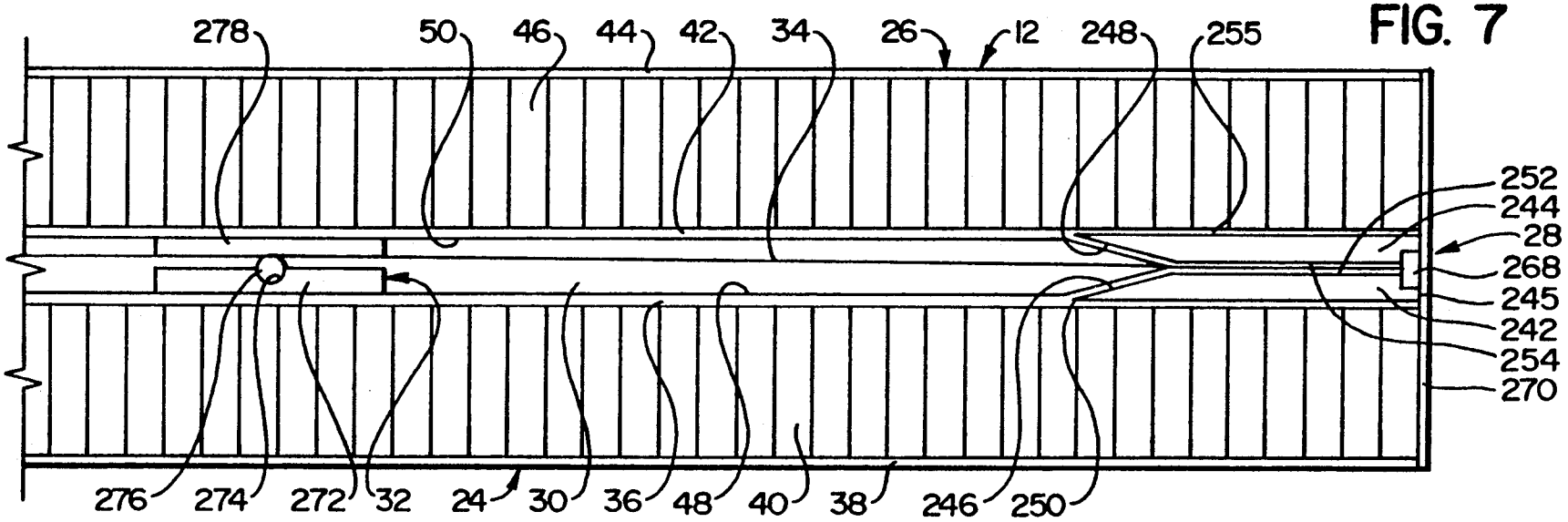
FIG. 7 is a sectional view taken perpendicular to an edge portion of a typical panel used to make the cargo container of the present invention, showing a perimeter portion and also one of the standoff units.

With reference to FIG. 7, it can be seen that an edge portion of the panel 12 is shown. This panel 12 comprises a first inner panel section 24 and a second outer panel section 26 which are joined to one another in spaced relationship by an edge panel assembly 28 to form an evacuated region 30 between the two panels 24 and 26. Also, there is a plurality of standoff units 32 which are positioned in a regularly spaced pattern in the evacuated region 30, these standoff units 32 maintaining the panel sections 24 and 26 in spaced relationship and withstanding the rather substantial compression loads imposed by atmospheric pressure on the panel sections 24 and 26.

There is a radiation shield 34 which extends throughout substantially the entire evacuated region 30. This radiation shield 34 is in the form of a plurality of quite thin reflective metallic sheets spaced from one another to accomplish (as the name implies) a reflection of radiant energy to improve the thermal insulating characteristics of the panel 12.

The panel sections 24 and 26 are designed to be relatively lightweight, occupy a relatively small volume, have adequate strength and structural rigidity, and yet be reasonably economical. In the preferred embodiment of the present invention, the basic structure of each panel section 24 and 26 is that of a honeycomb structure having outer and inner surface sheets which are bonded to a honeycomb core. The inner panel section 24 has its inner and outer sheets designated 36 and 38, respectively, and the core is designated 40. The inner and outer sheets of the outer panel section 26 are designated 42 and 44, respectively, with the core being designated 46. The basic honeycomb structure of the panel sections 24 and 26 is or may be of conventional design in that the honeycomb cores 40 or 46 are bonded to the inner and outer sheets 36/38 and 42/44, respectively. The atmospheric loads imposed on the panel sections 24 and 26 are reacted into the structure of the panel sections 24 as bending moments, and (as indicated previously) the compression loads between the panels 24 and 26 are taken by the standoff elements 32 and the edge piece assembly 28.

The interior surface of each of the panel sections 24 and 26 has a thin sheet of metallic foil 48 and 50, respectively, carefully bonded thereto, with these two foil sheets 48 and 50 extending into the edge assembly 28. These foil sheets 48 and 50 function to maintain the vacuum within the region 30, and also prevent "out gassing" into this region 30.

Also, each panel 12 through 18 is provided with a vent port 52 (desirably in the outer panel section 26) through which the panel region 30 is evacuated. In the finished container, this vent port 52 is closed by a suitable plug 54 positioned in a mounting ring 56 defining the vent 52 and enclosed by a cover plate 58. (See FIG. 12).

(c) Basic Construction of the Container 10

Each of the panel sections 12 through 18 is made as a single structurally unitary panel section. Thus, for example, the top panel 12 extends substantially the entire length and width of the container 10 and has a single edge perimeter assembly 28 extending around its entire perimeter. It is to be understood, of course, that it would be possible, for example, to make the top panel 12 (or one or more of the other panels 14 through 18) as a plurality of sections (possibly for manufacturing reasons or due to some other factor), but normally there would be no particular advantage in doing so, and possibly some disadvantages relative to thermal insulating characteristics.

Figure 3:
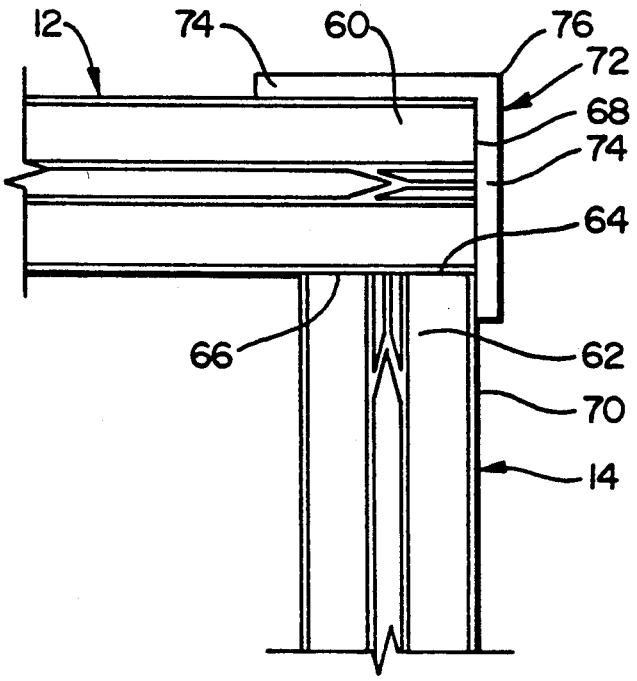
FIG. 3 is a sectional view taken along line 3—3 of FIG. 1, illustrating an edge section along the longitudinal axis of the container.

With reference first to FIG. 3, it can be seen that one longitudinal edge portion 60 of the upper panel 12 is joined directly to an upper longitudinal edge portion 62 of one of the side panels 14, with the edge surface 64 of the side panel 14 abutting against and joining to an adjacent edge bottom surface portion 66 of the panel 12. The outer edge surface 68 of the upper panel 12 lies in a plane parallel to the outside surface 70 of the side panel 14.

The surfaces 64 and 66 are bonded one to another by a suitable bonding agent. Also, there is a corner beam 72, formed as a right angle beam having flanges 74 joined at a corner junction location 76, this beam 72 extending the entire length of the container 10. Corner beams 72 are provided at the other longitudinal edges in substantially the same manner.

The opposite side of the panel 12 is joined to the other side panel 14 in the same manner as shown in FIG. 3. Further, the bottom panel 16 is joined along its longitudinal edge portions to the side panels 14 in a similar manner with the bottom edge surface of the two side panels 14 butting against, and being bonded to, the lower edge portions of the bottom panel 16.

Figure 4:
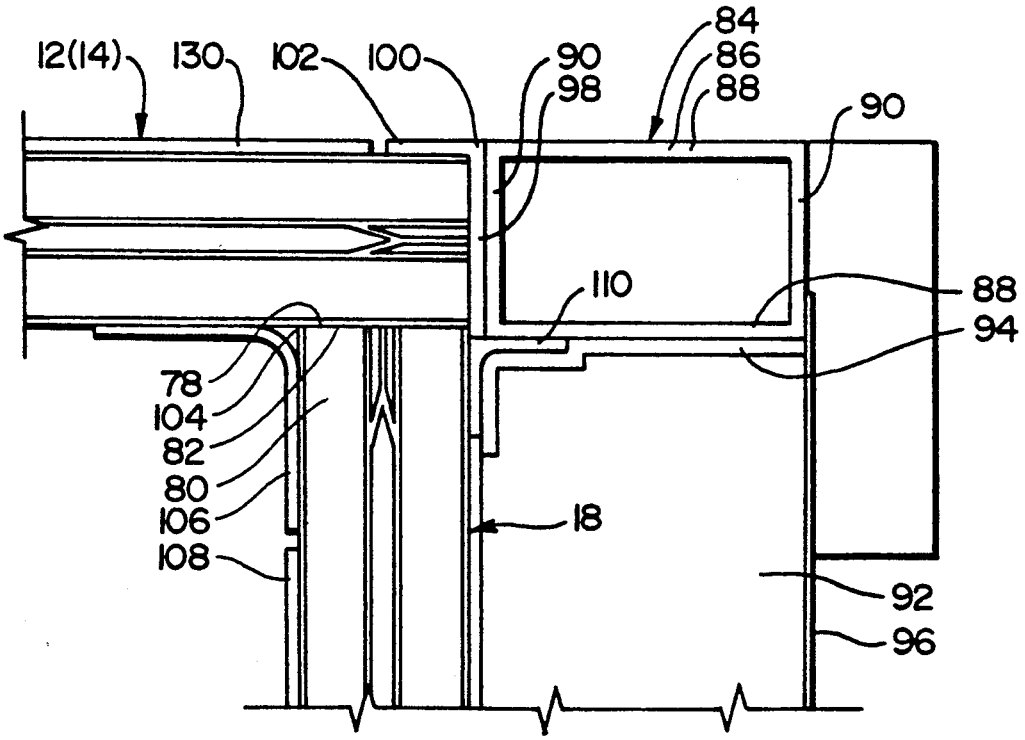
FIG. 4 is a sectional view taken along line 4—4 of FIG. 1, illustrating an edge section at the rear of the container.

The construction of the rear portion of the container 10 is illustrated in FIG. 4. The top edge surface 78 of the top edge portion 80 of the panel 18 butts against and is bonded to an inner side edge surface portion 82 of the top panel section 12. In like manner, the other edge surfaces of the rear panel 18 are bonded to the side and bottom panels 14 and 16. The arrangement shown in FIG. 4 is substantially the same around the entire perimeter of the rear end of the container 10.

There is at the rear of the container 10 a structural square frame 84, made up of four beams 86 joined to one another at their edge portions. Each beam section 86 has a box-like cross sectional rectangular configuration with two side walls 88 and two end walls 90. Positioned within the area defined by the square metal frame 84 is a low density foam panel 92. This panel 92 has a perimeter edge surface piece 94 to join to the frame 84, and also a rear outer protective cover sheet 96.

The forward facing surface of the frame 84 joins directly to one flange 98 of a right angle perimeter reinforcing member 100, the other flange 102 of which overlaps the rear outer surfaces of the top, bottom and side panels 12-16. The inner edge corner 104 extending around the entire perimeter of the rear panel 18 is covered by a protective right angle member 106. Also, the inner forward facing surface of the panel 18 is formed with a protective cover 108. Another reinforcing beam 110 (in cross section having two flanges in the form of a right angle) extends around the entire perimeter of the rear surface of the rear panel 18, with one flange of the member 110 being bonded to a rear perimeter surface portion of the Panel 18, and the other flange of the member 110 being bonded to an adjacent inside surface portion of the perimeter frame 84.

Figure 5:
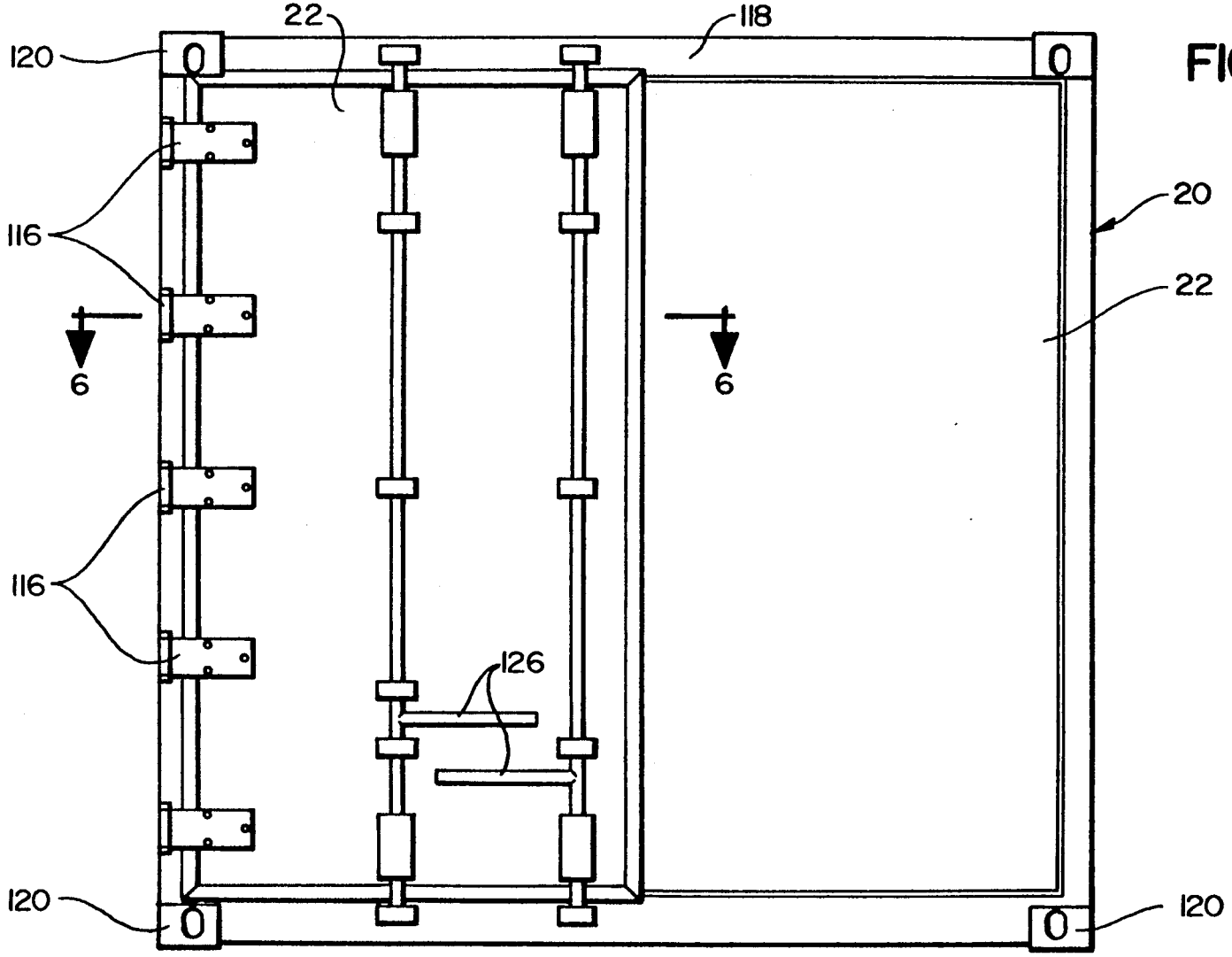
FIG. 5 is a front elevational view of the container.
Figure 6:
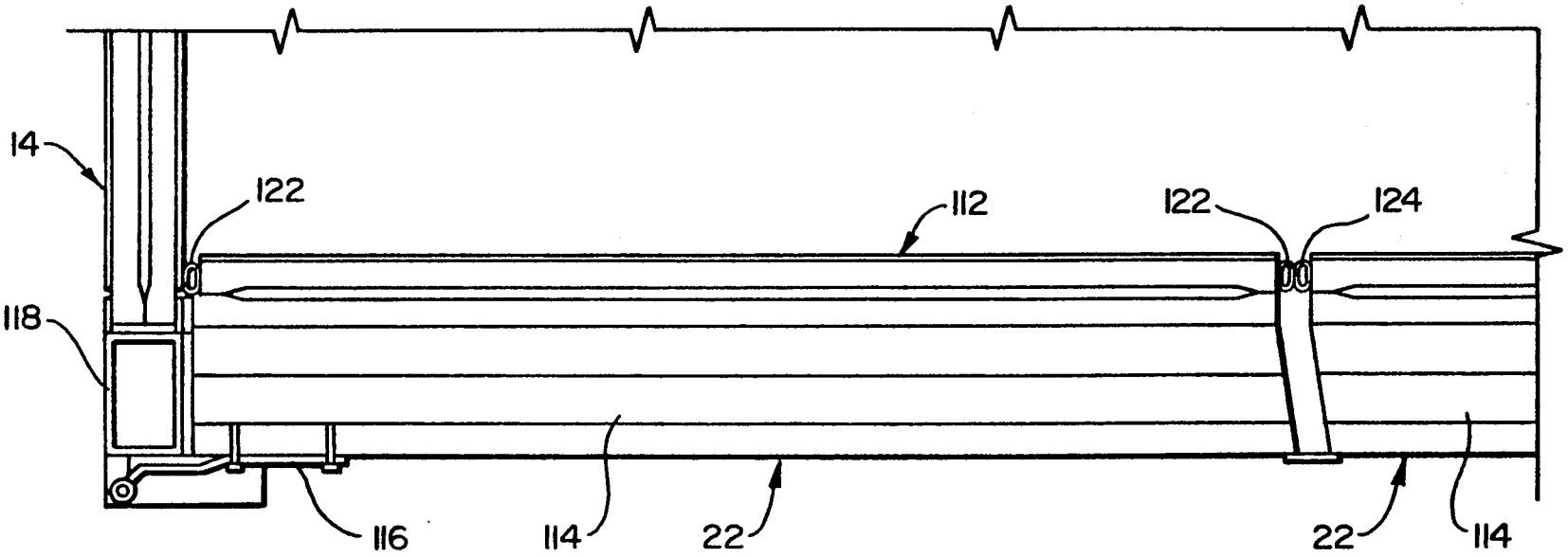
FIG. 6 is a sectional view taken along line 6—6 of FIG. 5, and illustrating the configuration of the doors of the container.

Reference is now made to FIGS. 5 and 6 to describe the front door section 20 of the container 10. As indicated previously, the front section 20 comprises two doors 22 that extend over the right and left halves (as seen in FIG. 5) of the forward end of the container 10. Each door 22 is made with a vacuum insulated door panel 112 that is the same as (or substantially the same as) the basic structure of the other panels 12 through 18. Each door panel 112 is bonded (or otherwise attached) to the rear surface of a basic door structure 114 which of itself may be of a conventional design. The two door structures 114 are mounted by suitable hinges 116 at the left and right forward vertical edge portions of the container 10.

There is a forward perimeter frame 118, which in terms of structure and function is substantially the same as (or similar to) the perimeter frame 84 at the rear end of the container 10. Also, at the four corners of the perimeter frame 118, there are lifting and stacking brackets or members 120. These members 120 are (or may be) of conventional design, and are common in the shipping industry. Therefore, these will not be described in detail herein. These lifting and stacking members 120 serve several functions. First, these can be engaged by hooks or other suitable attachments to lift the container 10.

Further, when the containers 10 are stacked one on top of the other, the lifting and stacking members 130 of vertically stacked containers engage one another to transmit the load from one container to the next. Third, these have interlocking devices so that the containers stacked one above the other can be removably secured to one another. Similar mounting and securing brackets or members 120 are provided at the rear of the container 10 and one of these is indicated at 120 in FIG. 4.

Each basic door structure 114 can be made of a plastic foam. Each door 22 is provided with suitable seals around its entire perimeter, with two such seals being shown at 122 and 124. Two middle portions of the seals 122 and 124 press against one another when the doors 22 are in their closed positions.

Each door is provided with securing handle mechanisms 126. For convenience of illustration these mechanisms 126 are shown mounted to only one of the doors 22.

The top, side and bottom panels 12-16 are provided with suitable protective cover sheets 130 (see FIG. 4). Further, similar protective covers are provided over the entire inner surfaces of these panels. In addition, a suitable floor would normally be positioned over the upper surface of the bottom panel 16, so that normal cargo loading procedures could be employed without damaging the bottom panel 16. For example, such flooring could be wood, particle board, plastic foam or some other suitable material.

(d) Creating the Vacuum in the Panel Region 30 and Closing the Vent Port 52 with the Plug 54

One of the more difficult problems to solve in arriving at a practical embodiment of the present invention was that of creating, and then maintaining an adequately low vacuum in the evacuated region 30 of each of the panels 12 through 18 and the two door panels 112. It was indicated earlier in this description that each outer panel section 26 of the panels 12 through 18 and 112 has a vent port 52 that is defined by the mounting ring 56. Also, it was pointed out that in each of the finished panels 12-18 and 112 a mounting plug 54 is positioned in the ring 56 to close the vent port 52 with a vacuum tight seal. The vacuum is initially created in each panel 12-18 and 112 by means of a pump assembly.

Figure 9A:
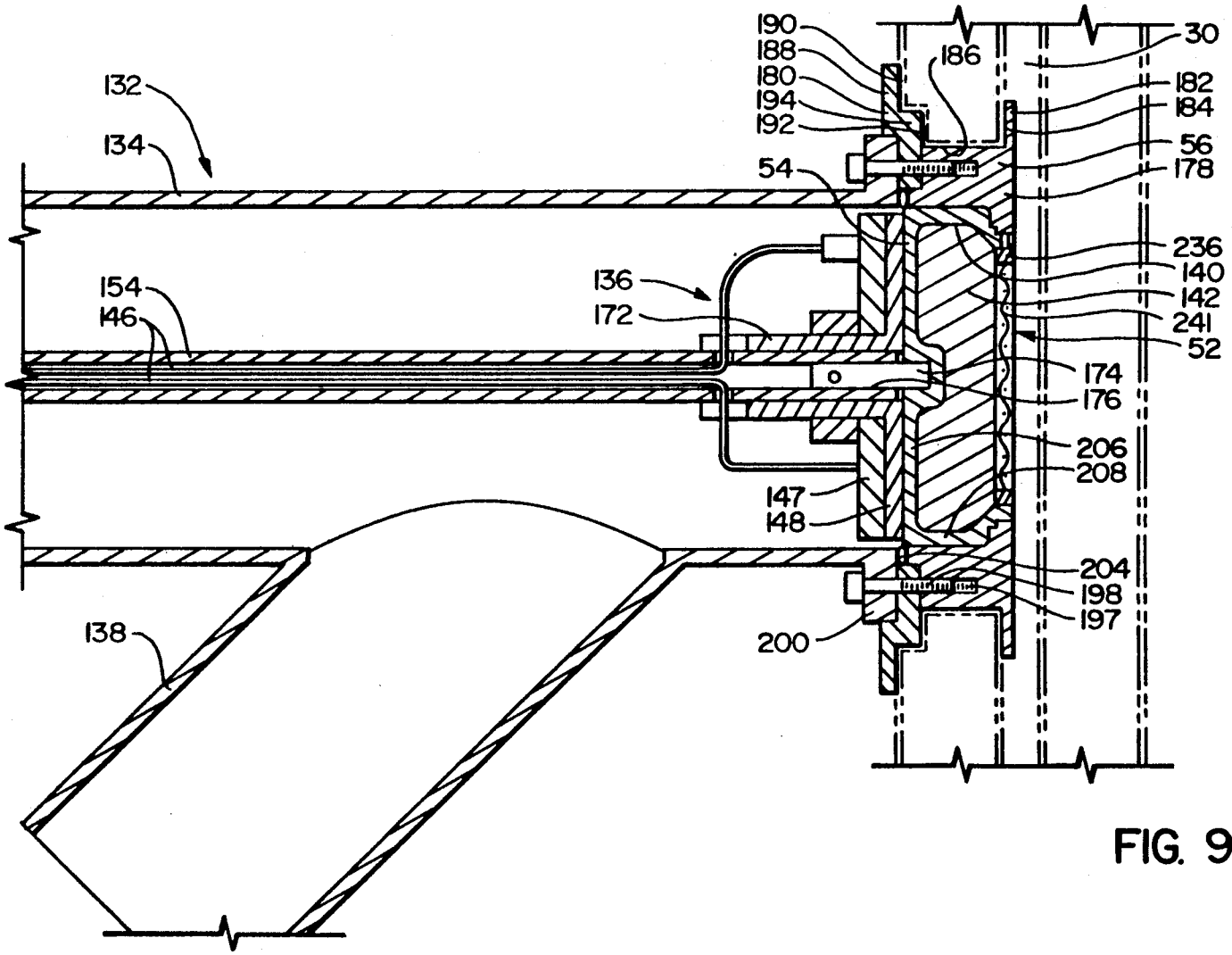
FIGS. 9A and 9B are two sections of a single drawing, taken in longitudinal sectional view, of a vacuum pump assembly used to evacuate the panels of the container.
Figure 9B:
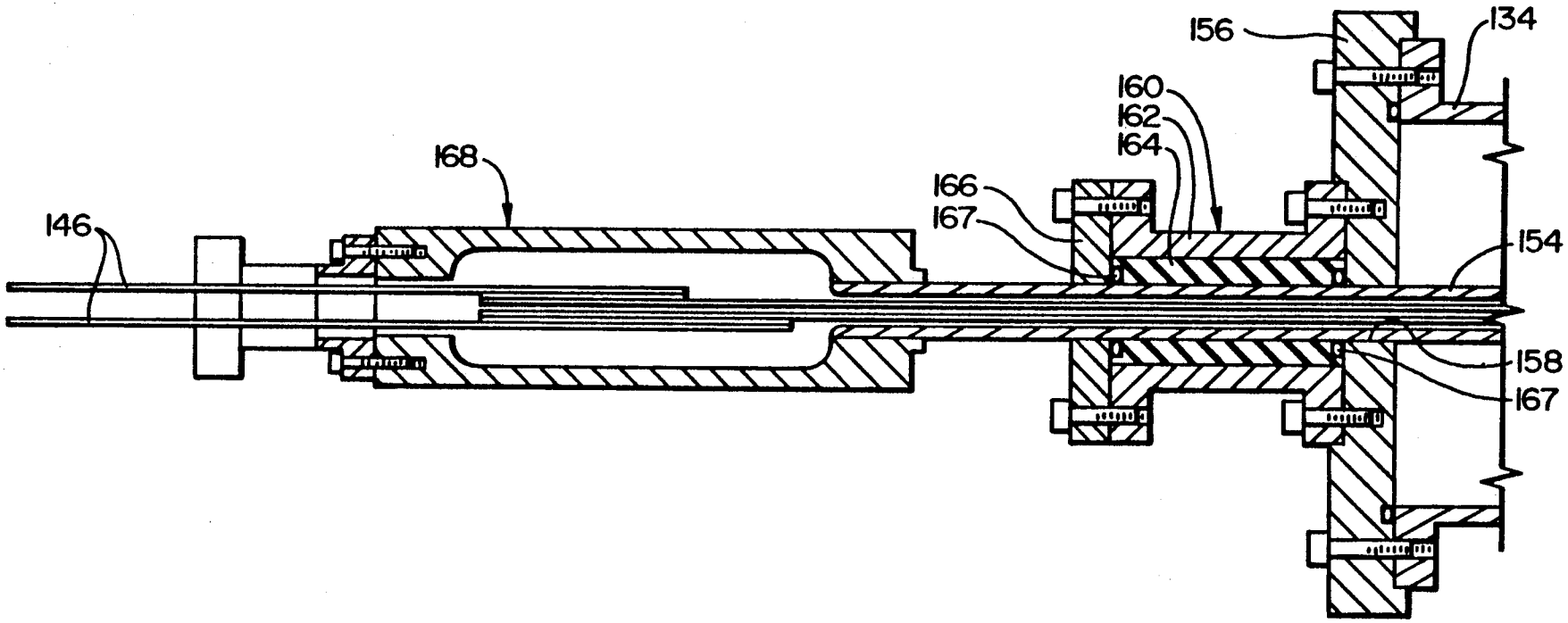

Reference is now made to the two sheets of drawings, FIGS. 9A and 9B which together show in longitudinal sectional view a pump and getter actuator assembly 132. This pump and getter actuator assembly 132 and the method of using the same in combination with the plug 54 and 56 are described also in a second patent application to be filed shortly after the present patent application. However, these will be described herein to ensure that there is a fully enabling disclosure in the present description.

Let us first assume that the panel 12 has been fully assembled and the components bonded together to make a finished panel. Further the mounting ring 56 has previously been installed in the opening formed in the outside panel section 26, and it is now necessary to evacuate the panel region 30 and close the vent port 52.

This pump and getter actuator assembly 132 comprises a main cylindrical housing 134 that is removably connected to the mounting ring 56 and which carries a plug positioning device 136. There is a branch pipe 138 connecting to and extending laterally and forwardly from the main housing 134. This pipe 138 connects to a vacuum pump which is (or may be) a commercially available vacuum pump capable of creating a vacuum down to as low as $1\times10^{-6}$ *torr*. (For convenience of description, the end of the assembly 132 furthest from the panel section 12-20 will be considered the front end, and the other end that is removably attached to the panel 12-20 will be considered the rear end.)

Figure 10:
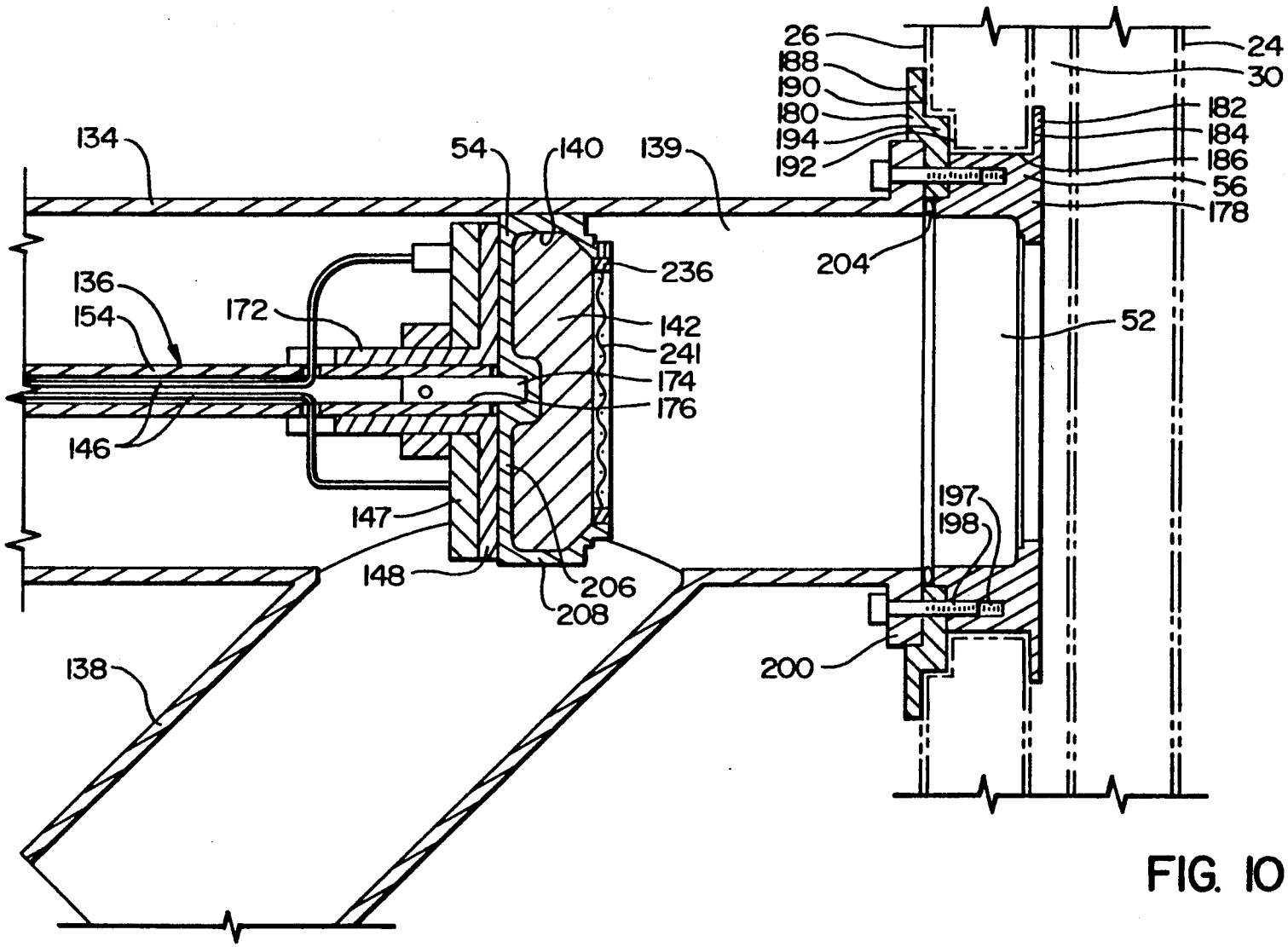
FIG. 10 is a sectional view similar to FIG. 9A, but showing the plug element of the vacuum pump assembly at a retracted position during the panel evacuating process.
Figure 11:
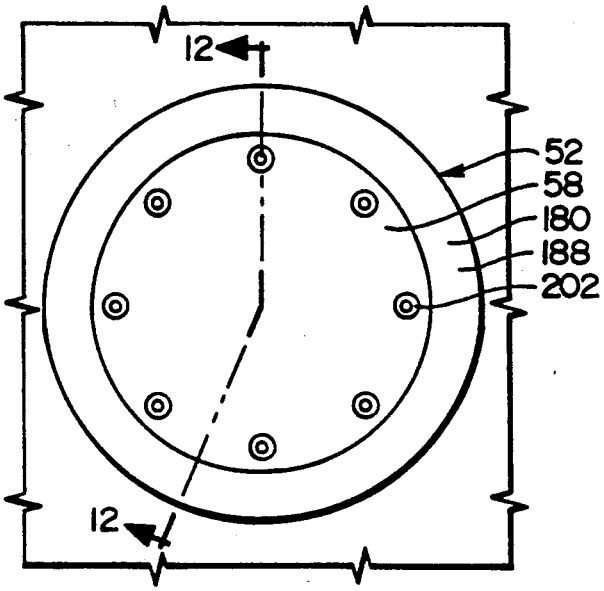
FIG. 11 is a plan view of the vacuum port of each of the panels, with the plug and the closures plate closing the port.

There will now be a brief description of the manner in which the assembly 132 operates, after which the details of this assembly 132 will be described. Initially, the plug 54 is releasably attached to the rear end of the plug positioned device 136, and the device 136 is located in a more forward retracted position so that the plug 54 is spaced from the port 52 (see FIG. 10). The rear open end of the pump assembly 132 is attached to the mounting ring 56, and (with the plug 54 in its retracted position as shown in FIG. 10) the plug 54 is spaced from the port 52 and permits the pipe 136 to communicate with rear end of the chamber 139 in the housing 134 which opens to the vent port 52.

The plug 54 has a circular configuration, and it defines a center open cavity 140 which contains a getter 142, which is a composition that is capable of forming a very high vacuum in the adjacent space by combining with gaseous particles located in the adjacent space to be evacuated. As shown in FIG. 10, with the housing 134 attached to the ring 56, and with the device 136 is positioned so that the plug 54 is retracted. The vacuum pump (not shown) that is attached to the pipe 138 is operated to draw a vacuum within the chamber 139 and in the interior region 30 of the panel down to as low a level as possible (e.g. as low as $1\times10_{-6}$ *torr*).

When this is accomplished, an electric current is directed through the wires 146 to raise the temperature of a heating element 147 located against the plate 148 to in turn raise the temperature of the getter 142 to a sufficiently high temperature (e.g. 85° to 900° F.) to activate the getter 142. Then the electric current is shut off, and the getter 142 in the plug 54 is permitted to cool. The heating of the getter 142 and then bringing this getter 142 down to a lower temperature has the effect of transforming the getter 142 into its "activated" condition. When this is done, the plug positioning device 136 is moved rearwardly to the position of FIG. 9A to push the plug 54 into seating engagement with the ring 56. With the getter material being activated, this getter material 152 reacts with gaseous particles in the region 30 so that these are entrapped in the getter. This continues for a period of time until a very low vacuum is formed in the region 30. In prototype panels already made, a vacuum as low as 10-6-Torr has been achieved. Since the manner in which a getter functions to create a high vacuum is well known, the details of the composition and function of the getter 142 will not be described herein. The reason for heating the gettering material while the plug 54 is positioned away from the mounting ring 56 is that the heat transmitted to the getter material would (if the plug 54 were mounted in the ring 56) be conducted into the ring 56 and damage the honeycomb structure of the panel 26.

With this operation being accomplished, the plug positioning device 136 is detached from the plug 54, and the pump assembly 132 is detached and removed from the mounting collar 56. Then the aforementioned cover plate 58 is bolted to the mounting ring 56, with a suitable shim 150 being positioned between the cover plate 58 and the outside surface 152 of the plug 54 to push the plug 54 firmly into its seated sealing position.

Now to describe the assembly 132 and the components associated therewith in more detail, the plug positioning device 136 comprises an elongate rod 154 which is slide mounted for longitudinal movement within the main housing 134. More particularly, the forward end of the housing 134 is closed by an end plate 156 having a central opening 158 to accommodate the rod 154. Bolted to the end plate 156 is a seal and bearing assembly 160 that comprises a mounting cylinder 162 bolted to the plate 156 and carrying therein a bearing member 164. There is an end closure plate 166 that is bolted to the cylinder 162. Suitable seals are provided at 167 on opposite sides of the bearing member 164, and this arrangement of the bearing 164 with the seals 156 permits the rod 154 to move forwardly and rearwardly, while providing a seal against outside air leaking into the chamber 144 within the housing 134. The outer end of the rod 154 connects to a handle portion 168, and the aforementioned electric wires 146 extend through this handle portion 168 to connect to an exterior source of electrical power.

The attaching end of the rod 154 extends into a cylindrical extension 172 of the aforementioned plate 148, and there is a connecting member 174 positioned within the end of the rod 54 which has a threaded end that screws into a threaded socket 176 formed in the center of the plug 54. When the plug is initially inserted into the chamber 144 of the housing 134, it is simply threaded onto the connecting member 174. After the plug 54 is positioned in seated sealing engagement with the ring 56, the rod 154 is rotated to disconnect the threaded connection 174 from the plug 54. This connecting and disconnecting of the rod 154 and the plug 54 could obviously be accomplished in other ways.

The aforementioned mounting ring 56 is made up of two collars 178 and 180. The collar 178 has a radially outwardly extending perimeter flange 182 which fits against an interior edge surface 184 surrounding an opening 186 formed in the panel section 26. This collar 178 is positioned in the opening 186 prior to the time the two panel sections 24 and 26 are being bonded one to another.

Figure 12:
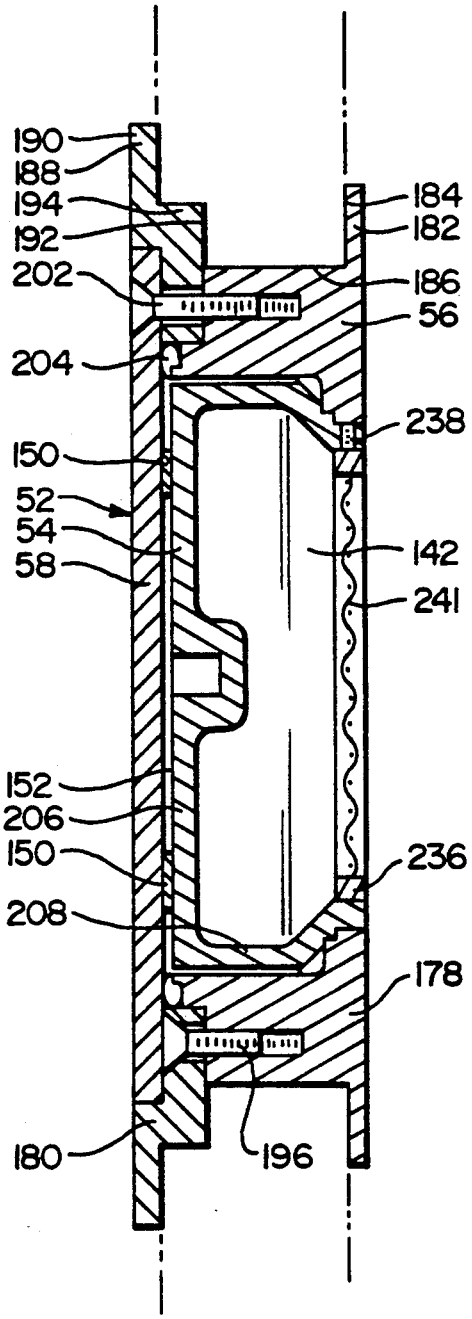
FIG. 12 is a sectional view taken along line 12—12 of FIG. 11.

The collar 180 is essentially a retaining collar, and it has a perimeter flange 188 which engages an outside edge surface portion 190 of the panel section 26. Also, the opening 186 is provided with an outer locating recess 192, and this interfits with an annular protruding portion 194 of the collar 180 to properly locate the collar 180. As can be seen in FIG. 12, the collar 180 is initially connected to the collar 178 by a set of countersunk screws 196 extending into matching threaded sockets in the collar 178. Also, as can be seen in FIG. 9A, 10 and 12, the collar 178 is provided with a second set of threaded sockets 197, with these sockets 197 performing two functions. First, during the pumping operation, these threaded sockets receive the threaded ends of several retaining bolts 198 that extend through a mounting flange 200 that is formed integrally at the inner end of the main housing 134 of the pumping and getter actuating assembly 132. Second, the sockets 198 receive the retaining screws 202 which hold the aforementioned cover plate 58 in its position, as shown in FIG. 12.

Also, the outwardly facing forward edge surface of the collar 178 has a circumferential seal 204 which forms a seal with the housing 134 during the pumping operation. The seal 204 is also positioned to provide a seal with the cover plate 58 (See FIG. 12).

One critical aspect of the present invention is that the panels 12-18 and 112 should be constructed in a manner that all surfaces exposed to the evacuated region 30 would not be the source of any "outgassing" by which material could escape from such material in a gaseous form to degrade the vacuum in the region 30. The manner in which this was solved rather uniquely in forming a proper seal between the plug 52 and the ring 56 will now be described with reference to FIG. 13.

The plug 54 is made of stainless steel for heat resistance and comprises a main plate 206 and an annular perimeter skirt or flange 208. The rear perimeter edge portion of the skirt 208 has a sealing portion 210 which slants radially inwardly and rearwardly in a frustoconical configuration. This portion 210 has an outward and rearwardly facing frusto-conical slanted surface portion 212 that forms with an adjacent right angle perimeter surface portion 214 of the collar 178 a triangularly shaped sealing area (i.e. triangularly shaped in a section taken transverse to the perimeter line), to receive a round rubber O-ring seal 216.

Figure 14:
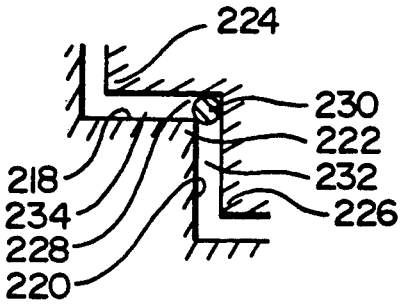
FIG. 14 is a perimeter sectional view of a metal seal section for the vent plug, drawn to an enlarged scale.

Radially inwardly and rearwardly of the surface 212, this plug portion 210 is formed with two adjacent right angle perimeter notches or recesses 218 and 220. Two surfaces of the recesses 218 and 220 meet at a circumferential edge 222. Also, the adjacent surface of the collar 178 is formed with two circumferential protruding right angle portions 224 and 226 that fit into and against the two recessed portions 218 and 220. Also, with reference to FIG. 14, it can be seen that the two protruding circumferential edge Portions 224 and 226 form between them a right angle circumferential recess 228, and the protruding edge portion 222 fits in the recess edge 228. In FIG. 14 the spacing of the adjacent surfaces is exaggerated to some extent for purposes of illustration.

With further reference to FIG. 14, a metal to metal seal is formed at the location of the protrusion recess 222/228 as follows. A small diameter wire 230 made of an extrudable metal (e.g. a wire made of indium having a diameter of 0.063 inch) is placed in the recess 228 so as to extend entirely around the entire circumference of this recess 228. When the plug 52 is finally pushed fully into place, the edge 222 bears against the wire 230 to cause it to extrude both laterally into the area 232 adjacent to the surface 220 and also into the area 234 adjacent to the surface 218. As the plug is forced into its fully seated engaged position, this extruded metal seal formed from the wire 230 is pressed more firmly into the adjacent confining surfaces to make a highly reliable and effective metal to metal seal.

After the gettering material 142 has been heated and then permitted to cool so as to become activated, as described previously, the plug 54 is then moved into the ring 56 by the operator manually grasping the handle 168 so as to push the plug 54 into its seated position. At this time, the rubber 0 ring seal 216 provides the initial seal so that the pump and getter actuating assembly 132 can be removed from the panel 12. Then when the cover plate 58 is put into place and tightened by means of the screws 202, the shims 150 press against the plug 54 in a manner to deform the indium wire 230 and make the more permanent metal seal for extra long range sealing capability.

Figure 13:
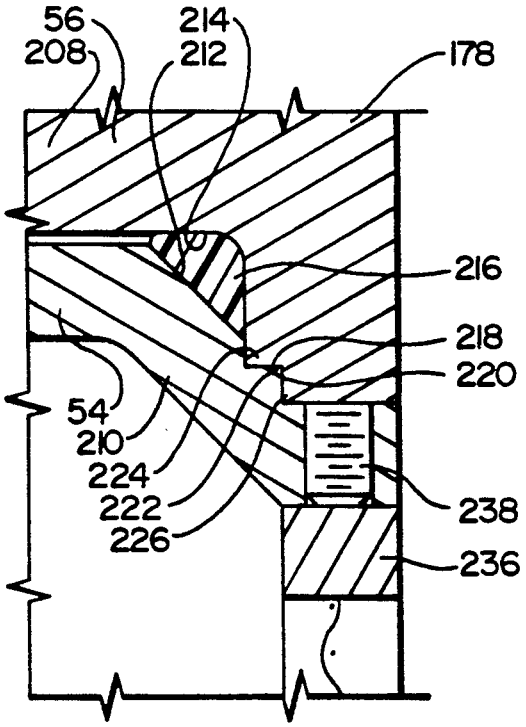
FIG. 13 is a view similar to FIG. 12, but drawn to an enlarged scale, and showing in section perpendicular to the perimeter of the vacuum port, a sealing portion of the plug and the mounting ring defining the vacuum port.

With further reference to FIG. 13, and also with reference to FIG. 12, there is shown a retaining ring 236 that fits inside the rear end edge portion of the plug 54. This ring is held in place by one or more retaining screws 238. This ring 236, along with a stainless steel screen 241, retains the getter 40 within the plug 54.

(e) The Edge Assembly of the Panels 12 through 20 and the Door Panel 112

As indicated earlier, the basic construction of each of the panels 12 through 18 and 112 is substantially the same, so earlier in this description, only panel 12 is described, it being understood that the same description would apply to the other panels 14-18 and 112. The same procedure will be followed in the following description.

Figure 8:
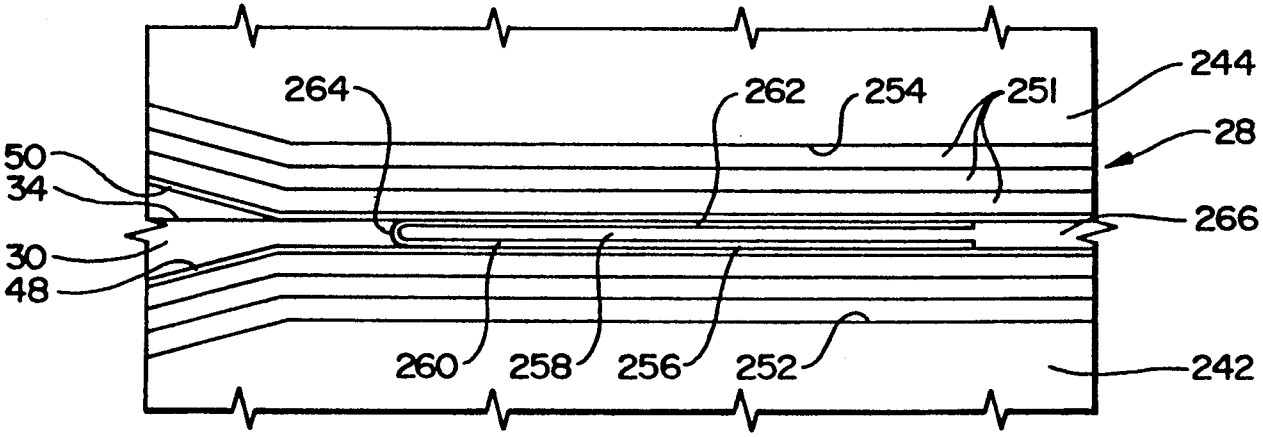
FIG. 8 is a view similar to FIG. 7, but showing to an enlarged scale the perimeter portion of the panel of FIG. 7.

With reference to FIGS. 7 and 8, the edge piece assembly 28 is made with two substantially identical edge members, namely an inner edge member 242 and an outer edge member 244. In cross section, each edge member 242 and 244 has a laterally outward square flat edge surface 245, and the inner edge is formed with a taper where the inside surfaces 246 and 248 slant away from one another, so that the overall configuration of the edge members 242 and 244 is trapezoidal. One reason for this tapered configuration is that with the substantial atmospheric loads being exerted against panels 24 and 26, there are rather large shear forces exerted on the panels 24 and 26 adjacent to the inner edge of the edge members 242 and 244. By providing the tapered configuration by the surfaces 246 and 248, the taper makes the members 242 and 244 somewhat more yielding toward their inner edges at 250. Accordingly, the shear loads are in a sense distributed over the inside surface portion of the edge members 242 and 244.

Also, as can be seen in FIG. 8, several layers 251 of the inner sheets 38 and 44 of the inner and outer panel sections 24 and 26 extend over the major portion of the honeycomb cores 40 and 46, respectively, and are positioned over the inside surfaces 246 and 248, and also over the surface portion 252 and 254 of the edge members 242 and 244. Other layers 255 of the sheets 38 and 40 extend between the edge member 28 and the honeycomb cores 40 and 46, respectively. Also, the two thin metallic foil sheets 48 and 50 extend up over the layers 251 so as to be closely adjacent to one another at the edge perimeter portion.

As indicated earlier herein, it is essential that the components be arranged so that there is substantially no "outgassing" into the evacuated region 30. The unique manner in which this outgassing problem is solved in forming the perimeter edge assembly 28 will now be described as reference to FIG. 8.

After the two panel sections 24 and 28 are formed with their edge members 242 and 244 bonded thereto, then each panel section 24 and 26 has its metal foil sheet 48 and 50 carefully bonded thereto so as to avoid any unbonded areas that would be large enough to cause atmospheric pressure to tear the foil sheet 48 or 50. Then one of the panel sections 24 or 26 with its aluminum foil 48 or 50 is laid horizontally with its aluminum foil sheet surface 48 or 50 positioned upwardly. Then an intermediate metallic perimeter foil member 256 is placed over the outer edge portion of the foil sheet 48 or 50, and a suitable bonding agent 258 is placed on one surface portion of this foil sheet 256. Then the perimeter foil sheet 256 is folded over on itself to form a lower layer 260 and an upper layer 262 joined at an inner curved section 264 so that the two layers 260 and 262 joined at 264 have a U shaped configuration that encloses the bonding agent 258 positioned therebetween.

Then when these two panel sections 24 and 26 are pushed together, the perimeter pieces 242 and 244 press toward each other and squeeze some of the bonding agent 258 laterally outwardly into the area 266 between the foil sheets 48 and 50 and outwardly of the U shaped sheet section 256. The bonding agent that flows outwardly into this area 266 then bonds the outer perimeter portions at the outer portions of the two foil sections 48 and 50 together so as to bond the panels one to another and form the edge piece assembly 28, while the metal layers 260 and 262 press directly against the adjacent portions of the metal foil sheets 48 and 50, respectively (without any adhesive therebetween) to form metal to metal sealing areas.

It can be seen from examining FIG. 8 that the bonding agent in the outer perimeter area 266 is isolated from the region 30 which is later to be evacuated. More particularly, the rounded edge portion 264 of the metallic foil piece 256 is exposed to the region 30. Also, the metallic foil sheets 48 and 50 located laterally inwardly from the rounded portion 264 are exposed to the region 30. The two sheet portions 260 and 262 press tightly against the adjacent portions of the foil sheets 48 and 50 to permit substantially no communication from the bonding area 266 to the region 30 that is to be evacuated. In this manner, the edge assembly 28 is formed without producing any significant "outgassing" problem of the bonding agent 266 being in communication with the interior evacuated region 30.

After the two panel sections 24 and 26 are joined together as described above, then a perimeter groove 268 is cut around the entire perimeter at the bond line, and this is filled with a suitable material, such as epoxy. Then a suitable perimeter cover layer is bonded to the entire edge portion of the panel 12. This edge cover sheet could be made of, for example, fiberglass, and this is shown at 270.

(f) Detailed Description of the Standoff Units 32

Reference is now made to FIG. 7, where there is shown one of the standoff units 32. This unit 32 comprises three components. There is a first mounting disk 272 having a diameter of between about 1½ to 2 inches, and this disk 272 is provided with a central hemispherical recess 274. Second there is a spherical spacing element 276 positioned in the recess 274. Third, there is a bearing disk 278 having a diameter the same as (or approximately the same as) the disk 272.

The mounting disk 272 functions to distribute the loading from atmospheric pressure over the inside surface area of the panel section 24 that the disk covers, and also to properly locate the spacing element 276. The bearing disk 278 functions to distribute the atmospheric load against the outer panel 26 over the surface portion of the panel section 26 that is adjacent to the bearing disk 278. The two disks 272 and 278 are cold soldered to their adjacent foil sheets 48 and 50, respectively, by a soft metal alloy, such as an indium alloy. The metallic material for the disks 272 and 278 is selected in relationship to the thickness dimension and diameter of the disk so that each disk 272 and 278 has sufficient strength, but yet is sufficiently yielding, so as to properly engage the adjacent portion of the panel section 24 or 26 to properly distribute the load.

To explain this further, as indicated previously, the atmospheric loads against the panel sections 24 and 26 will cause a certain amount of bending of these panel sections 24 and 26. If the disks 272 and 278 are made too rigid, then the load will tend to be concentrated toward the outer perimeter portions of the disks 272 and 278. On the other hand, if the disks 272 and 278 are too yielding, then the load would be concentrated too much toward the center portion of the disks 272 and 278.

Another consideration is that there must be allowance for some degree of lateral movement between the two disks 272 and 278, this depending to some extent on the location of that particular standoff unit 32. One main reason for this is that when there is a substantial temperature differential between the inside of the container 10 and ambient atmosphere, there will be thermal expansion and/or contraction that will cause certain portions of the panel sections 24 and 26 to move relative to one another in a direction parallel to the planes of these panels 24 and 26. If the individual spacing units 32 are constructed and arranged so that they provide strong resistance to such increments of relative lateral movement, then this could cause substantial shear stresses (or possibly other types of unwanted loading or stresses) in the adjacent portions of the panel sections 24 and 26. The manner in which this is avoided to a large extent is discussed immediately below.

The two disks 272 and 278 are each made of a moderately yielding metallic material. In this preferred embodiment, it was found suitable to use an aluminum metal. When the panel is assembled and the interior region 30 evacuated, then the substantial atmospheric forces against the panel sections 24 and 26 are imposed. This will cause the spherical spacing element to press into the disk 278 and form something of a dimple or a recess. Thus, when there is some relative lateral movement (i.e. movement parallel to the planes of the panel sections 24 and 26), the spacing element 276 will tend to push against the adjacent lateral surface portion of the recess 274 and the dimple or recess that is formed in the other bearing plate 278. However, the soft metal bond between the disks 272 or 278 and the foil sheets 48 and 50 will yield to some extent to permit such lateral relative movement without creating stress in the panel sections 24 and 26 over an acceptable limit. Also, there could be some deformations of the discs 272 or 278 to allow for such movement.

The spacing element 276 should have sufficient structural strength to carry the compression loads between the two disks 272 and 278, and also should be made of a material which has low thermal conductivity. It is found that these requirements can be met by using a spherical $ZrO_2$ ceramic ball of 3/16 inch diameter.

With regard to the dimensioning of the spacing element 276, this depends to a large extent upon the spacing of the standoff units 32. For example, if the spacing of the standoff units 32 is such that there is on the average one square foot of surface area per standoff unit 32, the load would be distributed so that there is approximately a force 2100 to 2200 pounds exerted on the individual standoff element 276. In addition to this compression force due to atmospheric loads, it can be anticipated there will sometimes be some lateral loading on these spacing elements 276 due to expansion and contraction. In general, on the basis of some experimentation and also analysis of the loads, for a spacing of the standoff elements of six to twelve inches, with the standoff units arranged in a square pattern, the standoff elements 276 made of the material noted above would have a diameter of about 3/16 inch.

Another consideration in selecting this particular arrangement of these standoff elements 276 is the ease and reliability of assembling these standoff units during the manufacturing operation of the panel. This problem is simplified simply by placing the disks 272 with the elements 276 in the recesses 274 on a lower positioned panel section (in this case panel section 24) after which the upper panel section 26 with the disks 278 soldered thereto is placed on top of the panel section 24 for the bonding operation. Since the spacing elements 272 are spherical, and thus totally symmetrical, there is no problem with alignment or orientation. Further, if there is some relative lateral movement between the disks 272 and 278 so as to cause some sort of rolling motion of the spacing elements 276, this also does not present any significant problem relative to transmitting loads because of the total symmetry of the spherical configuration. In a particular prototype of the present invention which was constructed, the spacing of the standoff units 32 in a square pattern was six inches. Further, the average distance between the two inner surfaces of the foil sheets 48 and 50 across the evacuated region 30 was about 0.375 inch. Under these circumstances, with the diameter of the disks 272 and 278 being 1½ inch, and with the thickness of the disk 272 being 0.187 inch, and the thickness of the disk 278 being 0.125 inch, the diameter of the spherical spacing elements 276 were made 0.187 inch. Further calculation has indicated that with this dimensioning and selection of materials of the standoff units 32, the spacing of the standoff units 32 could be made as great as 12 inches, while still adequately functioning to resist the compression loads and other loading, and also providing adequate spacing for the panel sections 24 and 26. A spacing of greater than 12 inches could be obtained , but with possibly larger dimensions of the balls 274 and disks 272 and 278.

(g) The Radiation Shield 34

Radiation shields made of thin reflective metallic sheets spaced from one another by a thermal insulating material are commercially available. In a typical example, the foil making up the metal sheets could be as thin as 0.0001 inch, and the thermally insulating spacing material could be, for example, a woven material or the like made of, for example, fiberglass.

The effectiveness of the radiation thermal barrier depends to a large extent on number of reflective foil sheets provided. Present analysis indicates that to achieve the insulating goals of the container 10 of the present invention, it would be desirable to have at least as many as forty spaced sheets of metallic reflective material. Of course, better results could be obtained by having yet a greater number.

With regard to the positioning of the radiation shield 34, in a prototype of the container 10 that was built, the radiation shield 34 was positioned in the evacuated area 30, in a manner that at the location of each spacing element 276, the shield 34 was simply positioned between that spacing element 276 and the disk 278. Subsequent analysis of the heat transfer characteristics of the panels so made indicated that the thermal shield 34 was likely working less effectively than it should. This is believed to have occurred because of a certain amount of wrinkling of the shield 34 that would cause it to thermally "short out" by forming thermal conductive paths between the layers of the shield 34.

It can be surmised that the effectiveness of the thermal shield 34 could be improved in various ways. For example, it may be desirable to simply form a small cutout of the shield 34 at the location of each of the spacing elements 276. In general, care should be taken that in making the initial layup, the shield 34 should be properly stretched so that it is as level as possible, and has as few wrinkles as possible.

(h) Manufacturing Techniques and Other Miscellaneous Features

In this section, there will be presented various information regarding the manufacturing techniques and various parameters that may prove to be helpful in practicing the present invention.

With regard to the various plastic materials used in making the container 10, such as the sheets 36, 38, 42 and other components, one desirable material is fibre reinforced composite plastic. Many of these are resistive to water, salt and high humidity conditions, and also can be made to be resistant to ultra-violet radiation. Such plastic products can be made to be very tough and are even used to make bullet proof jackets. Various reinforcing fibers were evaluated, such as carbon/graphite, aramide/kevlar, and glass. The carbon/graphite and kevlar have certain desirable characteristics. On the other hand, glass is believed to be more cost effective while having a desirable balance of the other characteristics to make it overall a desirable candidate. There are hundreds Of resin systems that could be used in making a composite material. Present analysis and experimentation indicates that an epoxy or polyester resin would be suitable.

Another advantage of using fibre reinforced composites is that the materials can be selected so that there is a very low coefficient of expansion. In fact, some plastics have close to zero coefficient of expansion for the thermal ranges in which the container 10 would be expected to function.

With regard to the vacuum formed in the evacuated region 30 of the panels, to achieve the desired insulating characteristics, the amount of residual gas left in region 30 should be sufficiently low so that the pressure in the chamber would be at least as low as ten microns of mercury, and it is in fact desirable to have the pressure substantially less than that level.

The design and selection of materials for the honeycomb core can be accomplished using standards reasonably acceptable in the aerospace industry. A honeycomb core marketed under the trademark "NOMEX" was used in a prototype of the container 10, and it was found to function satisfactorily. Another candidate would be a honeycomb material made of Craft paper, with a phenolic resin impregnated in the paper.

In forming the panel sections 24 and 26, one practical manufacturing technique is as follows. First, a layer of the aluminum foil 48 is placed on a mold which has a shape which the aluminum foil 48 takes in the finished panel construction (i.e. a shape that conforms to the evacuated region 30 and the edge configuration). The layer of foil is sealed to the tool base with a vacuum putty or chromate tape and a commercial grade vacuum is pulled under it (e.g. about twenty five inches of mercury). A first layer of fiberglass prepreg goes on top of the foil and is hand swept down into intimate contact with the foil, especially around the edges where the foil transits from the mold down to a fifteen degree angle to the tool base elevation. A debulking vacuum bag is applied at this point to insure good conformity of the foil and prepreg to the surface. The next step is to apply two more layers of prepreg with limited hand sweeping.

Then the foam edge piece 242 is put in place around the periphery of the panel. The next step is to apply three more layers of the prepreg to the layup, and a debulking bag is applied at this point to insure all components are well pressed into position. The bag is removed, and a core adhesive and then the honeycomb core panel 36 is then put on top of the layup. This is followed by a core adhesive and six more layers of prepreg. The last layer will be a peel ply. The entire layup is now ready for vacuum bagging for cure.

After vacuum bagging has then been accomplished, the assembled panel is moved into an autoclave or oven for cure. A typical cure cycle used was 255° F. and 45 PSI, and requires about four hours to complete. The other panel section 26 is prepared in a similar manner. The other panel section 26 is identical to the panel section 24 except that the vent port 52 is formed therein. At this time, the two collars 178 and 180 are positioned in the vent opening 52 formed in the honeycombed panel section. The panel halves are cleaned by standing them on edge and pouring aluminum acid etching solution over them. Other methods can be used, particularly for large scale production.

To assemble the panels, one panel half is set on a vacuum table foil-side up, and a standoff positioning template is indexed to the panel. Then the disks 272 of the standoff units 32 are positioned on the panel half and the spacing elements 276 are placed in the recesses 274 of the disks 272. Then the standoff positioning template is moved to the other half panel, and the radiation shield 34 is then positioned over the first panel section. In the prototype model built, the radiation shield or blanket was simply laid over the spacing elements 276. A possible alternative method would be to have openings in the radiation shield or blanket 34 so that the spacing elements 276 are positioned in these openings and do not press directly against the radiation shield or blanket 34.

It should be emphasized that this portion of the process of assembling the two panel halves should be accomplished in a very clean environment where there is tight control of contaminates maintained in the assembly area. For example, it would be desirable that the workers would wear lab coats, hair nets and white gloves. Other procedures could be initiated. The disks 278 are cold soldered to the second panel section. The second panel section 26 is then placed over the first panel section 24, and the edge sheet 256 is positioned as described previously herein. An epoxy adhesive is put in a fine line around the edge of the panel in the area within the edge sheet 258. The radiation shield or blanket 34 extends just to the inside of the edge portion. Then the panel 26 is placed on top of the other panel 24. The two panel sections are then vacuum bagged and cured for approximately one hour at 150° F.

The next step is to evacuate the interior panel region or chamber 30, and this is accomplished as described previously herein.

After the evacuation of the panel areas 30, the panels 12 through 18 are assembled in the configuration described previously herein. The other components, such as the end frames 84 and 118, the door 22, and the reinforcing beams 72 are bonded or otherwise secured to the structure as indicated previously herein.

(i) Thermal Insulating Characteristics of the Container 10

In addition to the various novel features described above, it is believed that another of the significant aspects of the present invention, relative to the prior art, is that there has not been an adequate understanding in the prior art of the relationship of the various elements of heat transfer in a thermal insulating containing structure between development themselves, and also not an adequate understanding of how these elements co-relate to practical and technical considerations of design and manufacture of such containers, coupled with such containers to function in a normal commercial shipping environment.

Figure 15:
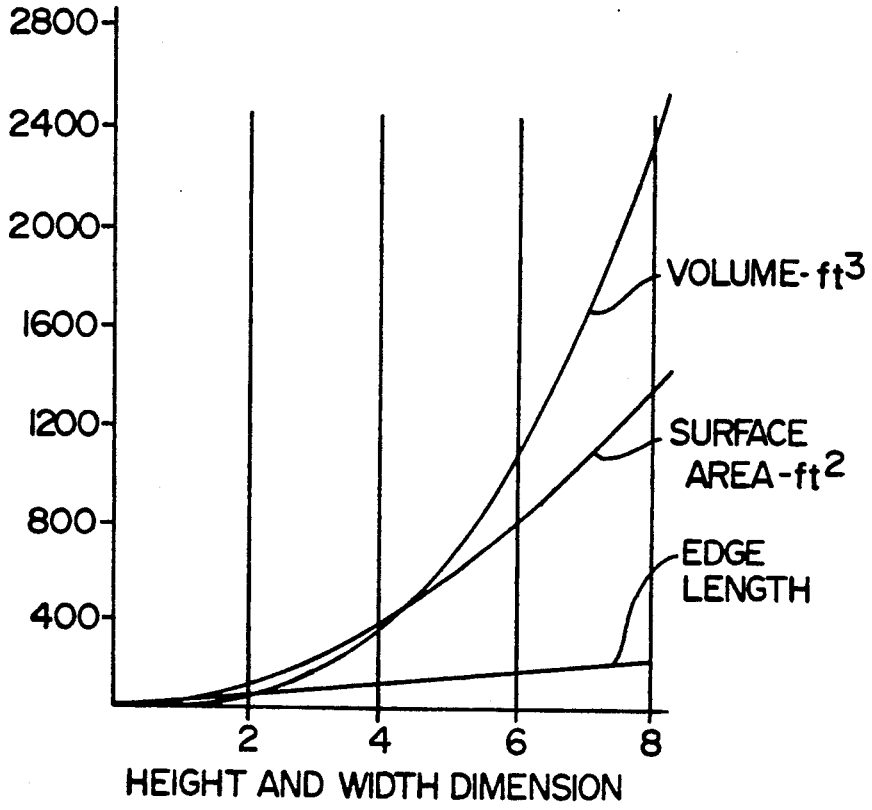
FIG. 15 is a graph plotting the volume, surface area and edge length dimensions of a rectangular prismatic container against the lineal dimension of the length and width dimensions of the container, where the lengthwise dimension of the container is five times either of the width or height dimensions, which are equal.

To explain this more fully, reference is first made to FIG. 15. It is a basic geometrical axiom that as the length, width, and height dimensions of an object are increased proportionately, the volume of the object increases in proportion to the third power of the increase in the lineal dimension, the surface area increases in accordance with the second power of the increase in the lineal dimension, while the edge length of any edges of this object increases proportionately to the increase in any lineal dimension. Let us relate this to an elongate cargo container in the shape of a rectangular prism, where the width and height dimension are equal, and the length dimension is five times either the height or width dimension. Let us first begin by considering a container whose dimensions are one foot in height, one foot in width, and five feet in length. Then we calculate the total volume of this container (disregarding for the moment any wall thickness), the surface area and also the lineal length of the edges of the container. For the one foot by one foot by five foot container, these would be as follows:

The volume equals five cubic feet (obtained by multiplying one times one times 5)

The surface area equals twenty two square feet (obtained by adding one plus one plus five times four)

The edge length equals twenty eight feet (obtained by adding four plus twenty plus four)

Now to proceed with this analysis, let us increase the size of this container proportionately so that we first double the height, width, length dimensions; then increase these by four times; then six times; and then eight times. Calculated values of the volume, surface area and edge length would be as follows:

TABLE

| CONTAINER SIZE | | | | | |
|---|---|---|---|---|---|
| Height | 1 ft | 2 ft | 4 ft | 6 ft | 8 ft |
| Width | 1 ft | 2 ft | 4 ft | 6 ft | 8 ft |
| Length | 5 ft | 10 ft | 20 ft | 30 ft | 40 ft |
| Volume ($ft_3$) | 5 | 40 | 320 | 1080 | 2560 |
| Surface Area ($ft_2$) | 22 | 88 | 352 | 792 | 1408 |
| Edge Length (ft) | 28 | 56 | 112 | 168 | 224 |

These values are illustrated in the graph of FIG. 15. Let us at this time make a brief analysis of the significance of these values relative to heat transfer characteristics. With regard to the volume of the container, assuming (for the purpose of analysis) that the entire cargo area is filled with a commodity having a certain specific heat. If the transfer of heat energy through the container is at a constant rate, the temperature change of the cargo is inversely proportional to the volume of the container.

With regard to the surface area of the exterior of the container, on the assumption that the thermal insulating capacity of the container remains constant over the entire surface of the container, the rate of heat transfer will be directly proportional to the surface area of the container.

With regard to the total lineal edge dimensions of the container, on the assumption that the heat transfer characteristics of the edge portions remain constant whether the container size is increased or decreased in size, the rate of heat transfer attributable to edge losses would be directly proportional to the lineal edge length.

What this preliminary analysis tells us is that as the size of the container is increased uniformly in all dimensions, the importance of the lineal edge portions of the container relative to thermal insulation value diminishes substantially, while the importance the surface area relative to insulation value increases substantially. At the same time, however, the volume is increasing at a much more rapid rate than the surface area and tends to have an offsetting effect proportionately greater than the effect of the insulating value of the surface area, and a much greater offsetting effect relative to the lineal edge length.

The next step in this analysis is to evaluate what the reasonably optimized thermal insulating value would be at the edge areas of the container and also at the surface areas of the panels. As indicated previously, a prototype of a container incorporating teachings of the present invention was constructed. This container had a height and width of eight feet each, but the length dimension (for purposes of building this prototype adequate for analysis of performance) was only made five feet. Certain tests were made by placing ice in the container and then taking various readings relative to heat transfer.

This testing indicated that the heat transfer for each unit of area of the wall was 0.03 BTUs per square foot per degree of Fahrenheit temperature differential per hour. The losses due to each foot of lineal edge dimension was equal to 0.04 BTUs per lineal foot per degree Fahrenheit per hour. On the basis of the data received and also analysis of the structure, it was reasonably estimated that the 0.03 BTU losses over each square foot of panel were due to about forty percent radiation losses and about sixty percent losses due to heat being conducted through the standoff units 32. (This is a rather rough approximation.)

Further structural analysis in the spacing of the standoff units 32 relative to performance indicated that the spacing of the standoffs relative to the cross sectional heat transfer area of the standoff units 32 could be increased so as to substantially improve the insulating characteristics of the panel surface areas to as much as three to four times. Also, analysis indicated that the radiation losses in this prototype were higher than what would normally be expected for the radiation shield used, and with improved techniques in placement of the radiation shield, and also possibly with using more layers of reflective metal foil in the radiation shield 34, this could at least be doubled in insulation value. Overall, it is surmised that these improvements would lower the heat transfer through the panels to a level of about 0.01 BTU per square foot per degree Fahrenheit temperature differential per hour.

Further, it was found that in designing the panels 12–18 and 112 to withstand the rather substantial atmospheric loads imposed thereon, the structural strength and rigidity of these panels was fully adequate to withstand the loads that a commercial cargo container would be expected to encounter with normal use. Present analysis indicates that an improvement in heat insulating characteristics could be gained at the edge areas by certain design modification and also limiting further the width of the contact areas of the panel edge assemblies.

For the sake of further analysis, let us relate the values indicated in FIG. 15 to the effect on heat transfer, by multiplying these values by the value by which these would affect thermal conductivity. In other words, the length dimension of the total edge length of the container would be multiplied by four since the rate of heat transfer would be assumed to be 0.04 BTUs per hour per lineal foot per degree Fahrenheit. The values of the surface area would remain at their square foot values, since the same value of heat transfer in BTUs is at one (the assumed reachable design level being 0.01 BTUs per hour per square foot per degree Fahrenheit differential per hour). The numerical values of the cubic feet of the container will not be changed. The results are shown in FIG. 16.

It can be seen that the edge losses go up linearly, while the panel losses go up by the square of the linear dimensions. Thus, it can be surmised that for a smaller container, such as one made four feet by four feet by twenty feet, the edge losses would be more significant. On the other hand for the full sized container of eight feet by eight feet by forty feet, it can be seen that the panel losses are about fifty percent greater than the edge losses. However, a significantly offsetting factor is that the volume is increasing by the cube of the lineal dimension, and to interpret the significance of this, reference is now made to the graph of FIG. 17.

Figure 16:
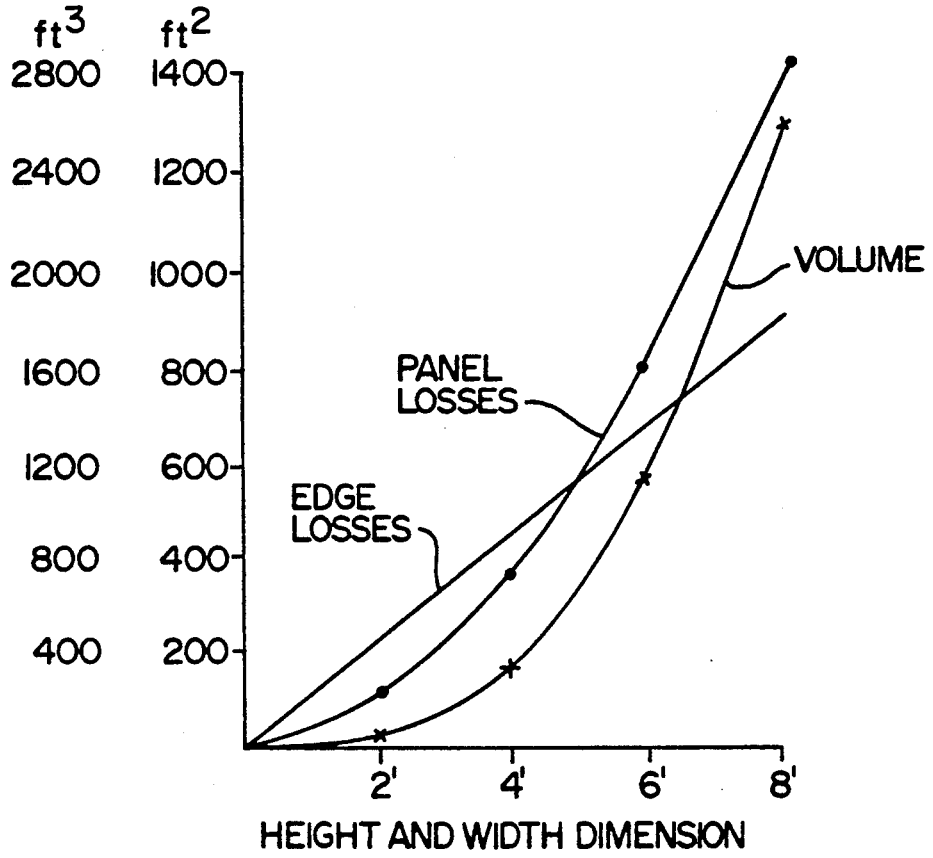
FIG. 16 is a graph similar to FIG. 15, where the surface area and the volume of the container are plotted along the vertical axis, and the width and height dimensions along the horizontal axis, with the curves illustrating functional relationships of heat loss due to volume change, surface area of the container, and lineal edge length of the container.
Figure 17:
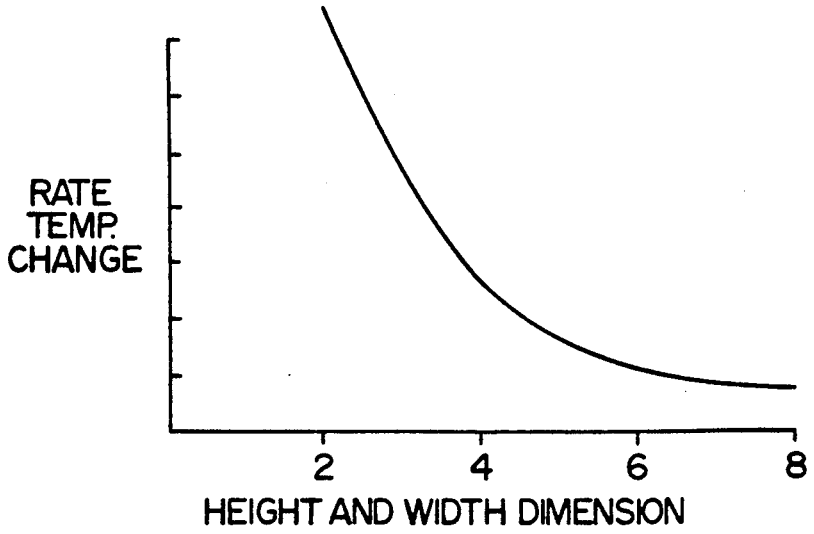
FIG. 17 is a graph illustrating the rate of temperature change of the container plotted against the width and height dimension of the container as described relative to FIGS. 15 and 16.

The values of this graph of FIG. 17 are arrived by calculating the heat losses derived from the graph of FIG. 16 and dividing these by the offsetting value of the volume of the cargo area. To appreciate this, we have to remember that the rate of change of the temperature (with the rate of heat transfer remaining constant) is inversely proportional to the volume, which means that it is inversely proportional to the lineal dimension of the cargo container cubed. When these values are calculated, it can be seen that for the cargo container that has an eight foot by eight foot by forty foot dimension, with the insulating value of each unit of panel surface area remaining constant, and with the heat insulating value of each unit of the edge portions remaining constant, the rate of temperature change in comparison with the cargo container having the four foot by four foot by twenty foot dimension is slightly over one-third as great.

Let us now discuss what other affects the increase in size of the container may have, relative to the construction of the container. It was indicated earlier that one of the most significant forces exerted on a vacuum insulated container is the compressive forces that tend to press together the inner and outer wall surfaces that define the evacuated area. As indicated earlier, this force would normally be in excess of two thousand pounds per square foot. In the container of the present invention, these compressive forces are resisted by the standoff units 32, and the honeycomb panel sections 24 and 26 acting as beams to resist the applied force between the standoff elements as bending moments. It has been found by analysis and also empirically that when the panel sections 24 and 26 are made strong enough to resist these substantial atmospheric compression loads, even for a container as large as eight foot by eight foot by forty or forty eight feet, the panel sections 24 and 26 have more than adequate structural strength to withstand the normal loads that would be imposed on the containers due to being loaded with cargo, lifted, subjected to impacts, etc. Therefore, it is realistic to assume that for a vacuum container constructed in accordance with the present invention, the same basic panel structure could be used for a larger container as would be required for a smaller container to function as a vacuum insulated container.

Further, this analysis indicates that the design considerations relative to the edges of the container become substantially less critical as the size of the container increases. The main reason for this is that while for a rather small container (e.g. one foot by one foot by four feet), the heat transfer losses at the edges of the container are by far the most critical factor in terms of heat loss, these are much less critical as the container goes up to commercial size (i.e. eight feet by eight feet by forty or forty eight feet). This allows more latitude in design criteria relative to structure, manufacturing techniques, etc. relative to the construction of the edges of the container. Further, structural strength and rigidity can be augmented at the edge portions simply by placing additional reinforcing structure along the edges in the form of, for example, right angle beams, which would result in no degradation in desired heat transfer characteristics and only slightly increase the overall dimensions.

As indicated in the initial portion of this section (i) dealing with the thermal insulating characteristic of the container 10, it is believed that the teachings of the prior art simply have failed reflect a proper understanding of the relevant factors and have failed to correlate these various factors properly to arrive at an optimized configuration of a full sized commercial heat insulating container incorporating the teachings of the present invention. To comment further on what the applicants believe to be the development of the prior art, when analysis has been done on smaller vacuum containers (e.g. containers to be used for cryogenic fluids or the like), analysis would indicate that making the vacuum insulated container in the shape of a rectangular prism would provide a relatively high surface area to container volume ratio, and a yet higher edge length to volume ratio. Accordingly, the conventional wisdom at that time would likely have been to simply design cylindrical containers with hemispherical end portions. However, as the size of such containers are increased, the structural design problems become more difficult (particularly the buckling of the outer shell).

Another factor that is likely relevant is that in recent decades there have been substantially improvements in providing commercially practical insulation material of higher insulating value. This also would tend to lead one toward selecting designs that depend on the insulating value of the material, as opposed to trying to overcome the difficulties of designing vacuum insulating panels. Further, as the heat insulating capacity of containers using insulating material increases, the refrigeration requirements for an insulating container of a given size would decrease. Accordingly, it is surmised that the trends in the prior art have been to depend more and more upon heat insulating containers that depend upon heat insulating materials, as opposed to vacuum insulating containers, except for smaller containers where cylindrical or spherical container configurations could be used.

In any event, whether the above given evaluation of the trend of the prior art is or is not correct, it is submitted that the present invention presents a commercially practical heat insulating container, particularly adapted for large commercial shipments, that provides a favorable balance of design features and functional characteristics that has not been recognized from the prior art.

It is to be recognized that various modifications could be made in the present invention without departing from the basic teachings thereof.

What is claimed:

1. A thermal insulating container, comprising:

a plurality of generally planar panels, each of which comprises a first inner air impervious panel section and a second outer air impervious panel section, with each of the first and second panel sections having:

i. first and second main panel portions, respectively, spaced from one another, and ii. first and second perimeter portions respectively, which extend entirely around the first and second main panel portions, respectively, and which are joined to one another to form an air impervious perimeter seal with said first and second main panel portions and parameter portions defining an evacuated region between said first and second panel sections;

b. a reflective radiation shield positioned in and extending across, said evacuated region, said radiation shield comprising a plurality of reflective sheets positioned in spaced overlapping relationship relative to one another;

c. a plurality of standoff units positioned at laterally spaced intervals in said evacuated region, and engaging said first and second panel sections to withstand compression loads created by ambient atmosphere pressure against said first and second panel sections d. said panels being joined to one another at edge portions thereof to form a thermally insulated enclosed containing area.

2. The container as recited in claim 1, wherein each of said panel sections comprises a first outer and a second interior sheet, and a core having a cellular structure positioned between, and connected to, said sheets to form a relatively rigid panel structure to resist said loads created by atmospheric pressure and to transmit said loads into said standoff units.

3. The container as recited in claim 2, wherein the loads created by atmospheric pressure are reacted in the first and second main panel portions primarily as bending moments in said first and second main panel portions.

4. The container as recited in claim 2, wherein said core comprises a honeycomb structure.

5. The container as recited in claim 2, wherein each inner surface of each of said first and second panel sections has an air impervious metallic layer immediately adjacent to said evacuated region capable of preventing any significant outgassing into said evacuated region.

6. The container as recited in claim 1, wherein each inner surface of each of said first and second panel sections has an air impervious metallic layer immediately adjacent to said evacuated region capable of preventing any significant outgassing into said evacuated region.

7. The container as recited in claim 6, wherein said metal layers extend into an area between the first and second perimeter portions of said panel sections.

8. The container as recited in claim 1, wherein each of said standoff units comprises first and second metal standoff plates positioned against inner surfaces of said first and second panel sections, and a spacing element having first and second contact surface areas to engage said first and second plates, said surface areas having a substantially smaller area than planar dimensions of said first and second plates.

9. The container as recited in claim 8, wherein each of said spacing elements has a substantially spherical configuration.

10. The container as recited in claim 9, wherein said first plate of each standoff unit has a recess to receive said spacing element to locate said spacing element relative to said first and second plates.

11. The container as recited in claim 8, wherein at least one of said plates of each standoff unit is connected to its related panel section by a bonding agent that permits limited lateral movement, whereby expansion or contraction of one of said panel sections relative to the other can be accommodated by lateral movement of said plate relative to its panel section.

12. The container as recited in claim 1, wherein there is positioned between the first and second perimeter portions of each panel a metallic edge joining member comprising first and second contact layers positioned against, said first and second perimeter portions, and an inwardly facing connecting portion connecting said first and second contact layers and presenting to said evacuated region a substantially continuous metallic surface, a bonding agent positioned within said edge joining member and extending in an outer direction from said evacuated area between said first and second perimeter portions of the first and second panel section.

13. The container as recited in claim 12, wherein said edge joining member comprises a substantially continuous metal sheet member folded over in a "U" shaped configuration to form said edge joining member.

14. The container as recited in claim 1, where each perimeter portion comprises an edge spacing member positioned inwardly from a plane defined by an inner surface of its related panel section so that two adjacent edge spacing members space the first and second main panel portions from one another, each edge spacing member having an inward tapered portion that tapers in an inward direction toward said evacuated region and bears against its related panel section, whereby compression loads exerted on said first and second panel sections are resisted by the tapered portions of the edge member yielding moderately to distribute loads thereon.

15. The container as recited in claim 14, further comprising first and second impervious metal layers positioned on inside surfaces of said first and second panel sections, said first and second metal layers extending over the tapered edge portions into an area between said edge spacing members.

16. The container as recited in claim 1, wherein one of said panel sections has an opening therein, a mounting ring positioned in said opening, and a plug inserted in said mounting ring to close off said evacuated area, said plug and said mounting ring being arranged with an annular recess formed in one of said ring and plug and an annular protrusion being formed in the other of said ring and plug, an extrudable metallic seal member being positioned within said recess and against said protrusion, in a manner that with said plug being forced into engagement with said ring, said metallic seal member is extruded outwardly into adjacent surfaces of said ring and said plug member.

17. The container as recited in claim 16, wherein said container further comprises a cover plate arranged to fit over said plug member and press against said mounting ring, said cover plate and said mounting ring having a yielding seal therebetween to function as a temporary seal prior to said plate pressing against said plug member to cause extrusion of said metallic seal member.

* * * * *